US010861416B2

(12) United States Patent
Kim et al.

(10) Patent No.: US 10,861,416 B2
(45) Date of Patent: Dec. 8, 2020

(54) METHOD OF PERFORMING COLOR GAMUT CONVERSION AND DISPLAY DEVICE EMPLOYING THE SAME

(71) Applicant: Samsung Display Co., LTD., Yongin-si (KR)

(72) Inventors: Haneul Kim, Seoul (KR); Byungki Chun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 12 days.

(21) Appl. No.: 16/186,353

(22) Filed: Nov. 9, 2018

(65) Prior Publication Data

US 2019/0147832 A1 May 16, 2019

(30) Foreign Application Priority Data

Nov. 13, 2017 (KR) ..... 10-2017-0150663

(51) Int. Cl.
*G09G 5/06* (2006.01)

(52) U.S. Cl.
CPC ..... *G09G 5/06* (2013.01); *G09G 2320/0666* (2013.01); *G09G 2320/0673* (2013.01); *G09G 2340/06* (2013.01)

(58) Field of Classification Search
CPC ..... G09G 2320/0673; G09G 5/06
See application file for complete search history.

(56) References Cited

U.S. PATENT DOCUMENTS

2005/0200869 A1* 9/2005 Hayaishi ..... G06T 11/001 358/1.9
2008/0297530 A1* 12/2008 Ramstad ..... G09G 3/003 345/589
2009/0184955 A1* 7/2009 Thiele ..... G06T 15/06 345/419
2011/0057950 A1* 3/2011 Kim ..... G09G 5/02 345/602

(Continued)

FOREIGN PATENT DOCUMENTS

KR 10-2014-0064485 5/2014

OTHER PUBLICATIONS

"Euclidean Distance", Sep. 2016, Wikipedia, pp. 1-4 (Year: 2016).*

*Primary Examiner* — Terrell M Robinson
(74) *Attorney, Agent, or Firm* — Lewis Roca Rothgerber Christie LLP

(57) ABSTRACT

A method of performing color gamut conversion obtains an ICC profile from image data and extracts XYZ values of red, green, blue, cyan, magenta, yellow, and white of a target color gamut of an image and X'Y'Z' values of red, green, blue, cyan, magenta, yellow, and white of a reference color gamut of a display device from the ICC profile. The method further calculates a reference color gamut applying matrix that converts the XYZ values to the X'Y'Z' values, RGB values of red, green, blue, cyan, magenta, yellow, and white of the target color gamut, and R'G'B' values of red, green, blue, cyan, magenta, yellow, and white of the reference color gamut using the reference color gamut applying matrix and a RGB-XYZ converting matrix. A look-up table including the RGB values and the R'G'B' values is generated and the image data is compensated based on the look-up table.

20 Claims, 9 Drawing Sheets

(56) References Cited

U.S. PATENT DOCUMENTS

| | | | | |
|---|---|---|---|---|
| 2011/0157212 | A1* | 6/2011 | Zhang | H04N 9/67 345/590 |
| 2014/0028696 | A1* | 1/2014 | Kulkarni | G06T 19/20 345/582 |
| 2014/0140616 | A1* | 5/2014 | Choi | H04N 1/6058 382/167 |
| 2014/0218386 | A1* | 8/2014 | Tatsuno | G09G 3/3648 345/590 |
| 2015/0077771 | A1* | 3/2015 | Kobayashi | H04N 1/00482 358/1.9 |
| 2017/0187926 | A1* | 6/2017 | Morovic | H04N 1/6008 |

* cited by examiner

METHOD OF PERFORMING COLOR GAMUT CONVERSION AND DISPLAY DEVICE EMPLOYING THE SAME

CROSS-REFERENCE TO RELATED APPLICATION

This application claims priority to and the benefit of Korean Patent Application No. 10-2017-0150663, filed on Nov. 13, 2017 in the Korean Intellectual Property Office (KIPO), the contents of which are incorporated herein in its entirety by reference.

BACKGROUND

1. Field

Example embodiments relate to a display device.

2. Description of the Related Art

Generally, a target color gamut (e.g., sRGB color gamut, etc) of an image which is generated with the target color gamut by a digital camera, a camcorder, etc, needs to be identical to a reference color gamut of a display device for the display device to display the image with an exact color. However, because various types of color gamuts exist, and because manufacturers use different color gamuts for various reasons, the display device performs color gamut conversion on image data in order to display a specific image with an exact color.

To perform a mapping between the reference color gamut of the display device and the target color gamut of the image, a conventional color gamut converting technique first converts RGB values of red (R), green (G), blue (B), cyan (C), magenta (M), yellow (Y), and white (W) of the target color gamut to tristimulus XYZ values. The tristimulus XYZ values are then converted to tristimulus X'Y'Z' values by applying the reference color gamut. The tristimulus X'Y'Z' values are then converted to R'G'B' values of red, green, blue, cyan, magenta, yellow, and white of the reference color gamut. A look-up table is generated that maps the RGB values of red, green, blue, cyan, magenta, yellow, and white of the target color gamut to the R'G'B' values of red, green, blue, cyan, magenta, yellow, and white of the reference color gamut whenever the target color gamut of the image is changed. The above operation generally needs to be performed by a high performance processor. Thus, the look-up table for a mapping between the reference color gamut of the display device and the target color gamut of the image needs to be generated externally and provided to the display device. For this reason, the conventional color gamut converting technique is typically not used to perform the color gamut conversion on the image data in real time.

SUMMARY

Some example embodiments provide a method of performing color gamut conversion on image data in real time as a target color gamut of an image is changed by allowing a display device to directly generate a look-up table for a mapping between a reference color gamut of the display device and the target color gamut of the image using an international color consortium (ICC) profile.

Some example embodiments provide a display device that employs the method of performing the color gamut conversion.

According to an aspect of example embodiments, a method of performing color gamut conversion may include an operation of obtaining an international color consortium (ICC) profile included in image data, an operation of extracting XYZ values of red, green, blue, cyan, magenta, yellow, and white of a target color gamut of an image that the image data implements and X'Y'Z' values of red, green, blue, cyan, magenta, yellow, and white of a reference color gamut of a display device from the ICC profile. The method also has an operation of calculating a reference color gamut applying matrix that converts the XYZ values to the X'Y'Z' values, an operation of calculating RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix, an operation of generating a look-up table that includes the RGB values and the R'G'B' values mapped to the RGB values, and an operation of compensating the image data based on the look-up table.

In example embodiments, the method may further include an operation of extracting a gamma value of the display device from the ICC profile, an operation of determining a luminance level correction value based on the gamma value, and an operation of reflecting the luminance level correction value on the look-up table.

In example embodiments, the XYZ values may correspond to maximum chroma red, maximum chroma green, maximum chroma blue, maximum chroma cyan, maximum chroma magenta, maximum chroma yellow, and maximum chroma white of the target color gamut. In addition, the X'Y'Z' values may be for maximum chroma red, maximum chroma green, maximum chroma blue, maximum chroma cyan, maximum chroma magenta, maximum chroma yellow, and maximum chroma white of the reference color gamut.

In example embodiments, the RGB values may correspond to maximum chroma red, maximum chroma green, maximum chroma blue, maximum chroma cyan, maximum chroma magenta, maximum chroma yellow, and maximum chroma white of the target color gamut. In addition, the R'G'B' values may correspond to maximum chroma red, maximum chroma green, maximum chroma blue, maximum chroma cyan, maximum chroma magenta, maximum chroma yellow, and maximum chroma white of the reference color gamut, where the R'G'B' values are mapped to the RGB values.

In example embodiments, the look-up table may further include additional mappings generated by performing an interpolation on mappings between the RGB values and the R'G'B' values.

In example embodiments, the target color gamut may be a sRGB color gamut, an adobe RGB color gamut, or a DCI-P3 color gamut.

According to another aspect of example embodiments, a method of performing color gamut conversion may include an operation of preparing a first look-up table that includes R1G1B1 values of red, green, blue, cyan, magenta, yellow, and white of a first target color gamut and R1'G1'B1' values of red, green, blue, cyan, magenta, yellow, and white of a reference color gamut, where the R1'G1'B1' values are mapped to the R1G1B1 values and an operation of preparing a second look-up table that includes R2G2B2 values of red, green, blue, cyan, magenta, yellow, and white of a second target color gamut and R2'G2'B2' values of red, green, blue, cyan, magenta, yellow, and white of the reference color gamut, where the R2'G2'B2' values are mapped to the R2G2B2 values. An international color consortium (ICC)

profile is obtained from image data and third coordinates of red, green, blue, cyan, magenta, yellow, and white of a third target color gamut of an image that the image data implements from the ICC profile are extracted. First distances between first coordinates of red, green, blue, cyan, magenta, yellow, and white of the first target color gamut and the third coordinates and second distances between second coordinates of red, green, blue, cyan, magenta, yellow, and white of the second target color gamut and the third coordinates are calculated. A third look-up table that includes R3G3B3 values of red, green, blue, cyan, magenta, yellow, and white of the third target color gamut and R3'G3'B3' values of red, green, blue, cyan, magenta, yellow, and white of the reference color gamut, where the R3'G3'B3' values are mapped to the R3G3B3 values is generated by performing an interpolation between the first look-up table and the second look-up table based on the first distances and the second distances. Image data is compensated based on the third look-up table.

In example embodiments, the interpolation may be a linear interpolation.

In example embodiments, the first distances may be calculated using [Equation 1] below:

$$D1=\sqrt{(x3-x1)^2+(y3-y1)^2}, \quad \text{Equation 1}$$

where D1 denotes the first distances between the first coordinates and the third coordinates, (x3, y3) denotes the third coordinates, and (x1, y1) denotes the first coordinates.

In example embodiments, the second distances may be calculated using [Equation 2] below:

$$D2=\sqrt{(x3-x2)^2+(y3-y2)^2}, \quad \text{Equation 2}$$

where D2 denotes the second distances between the second coordinates and the third coordinates, (x3, y3) denotes the third coordinates, and (x2, y2) denotes the second coordinates.

In example embodiments, the R3G3B3 values and the R3'G3'B3' values may be calculated using [Equation 3] below:

$$R_3 = \frac{(R_1 \times D2) + (R_2 \times D1)}{(D1 + D2)} \quad \text{Equation 3}$$

$$R'_3 = \frac{(R'_1 \times D2) + (R'_2 \times D1)}{(D1 + D2)}$$

$$G_3 = \frac{(G_1 \times D2) + (G_2 \times D1)}{(D1 + D2)}$$

$$G'_3 = \frac{(G'_1 \times D2) + (G'_2 \times D1)}{(D1 + D2)}$$

$$B_3 = \frac{(B_1 \times D2) + (B_2 \times D1)}{(D1 + D2)}$$

$$B'_3 = \frac{(B'_1 \times D2) + (B'_2 \times D1)}{(D1 + D2)},$$

where R1 denotes the R1 values, G1 denotes the G1 values, B1 denotes the B1 values, R2 denotes the R2 values, G2 denotes the G2 values, B2 denotes the B2 values, R3 denotes the R3 values, G3 denotes the G3 values, B3 denotes the B3 values, R1' denotes the R1' values, G1' denotes the G1' values, B1' denotes the B1' values, R2' denotes the R2' values, G2' denotes the G2' values, B2' denotes the B2' values, R3' denotes the R3' values, G3' denotes the G3' values, B3' denotes the B3' values, D1 denotes the first distances between the first coordinates and the third coordinates, and D2 denotes the second distances between the second coordinates and the third coordinates.

In example embodiments, the method may further include an operation of extracting a gamma value of the display device from the ICC profile, an operation of determining a luminance level correction value based on the gamma value, and an operation of reflecting the luminance level correction value on the third look-up table.

In example embodiments, the R1G1B1 values may correspond to maximum chroma red, maximum chroma green, maximum chroma blue, maximum chroma cyan, maximum chroma magenta, maximum chroma yellow, and maximum chroma white of the first target color gamut. In addition, the R1'G1'B1' values may correspond to maximum chroma red, maximum chroma green, maximum chroma blue, maximum chroma cyan, maximum chroma magenta, maximum chroma yellow, and maximum chroma white of the reference color gamut, where R1'G1'B1' values are mapped to the R1G1B1 values.

In example embodiments, the R2G2B2 values may correspond to maximum chroma red, maximum chroma green, maximum chroma blue, maximum chroma cyan, maximum chroma magenta, maximum chroma yellow, and maximum chroma white of the second target color gamut. In addition, the R2'G2'B2' values may correspond to maximum chroma red, maximum chroma green, maximum chroma blue, maximum chroma cyan, maximum chroma magenta, maximum chroma yellow, and maximum chroma white of the reference color gamut, where R2'G2'B2' values are mapped to the R2G2B2 values.

In example embodiments, the R3G3B3 values may correspond to maximum chroma red, maximum chroma green, maximum chroma blue, maximum chroma cyan, maximum chroma magenta, maximum chroma yellow, and maximum chroma white of the third target color gamut. In addition, the R3'G3'B3' values may correspond to maximum chroma red, maximum chroma green, maximum chroma blue, maximum chroma cyan, maximum chroma magenta, maximum chroma yellow, and maximum chroma white of the reference color gamut, where R3'G3'B3' values are mapped to the R3G3B3 values.

In example embodiments, the third look-up table may further include additional mappings generated by performing an interpolation on mappings between the R3G3B3 values and the R3'G3'B3' values.

According to an aspect of example embodiments, a display device may include a display panel including a plurality of pixels, a display panel driving circuit configured to drive the display panel, and a color gamut converting circuit configured to extract an international color consortium (ICC) profile included in image data, to generate, using the ICC profile, a look-up table for a mapping between a reference color gamut of the display panel and a target color gamut of an image that the image data implements, and to compensate the image data based on the look-up table.

In example embodiments, the color gamut converting circuit may be implemented in the display panel driving circuit.

In example embodiments, the color gamut converting circuit may be configured to extract XYZ values of red, green, blue, cyan, magenta, yellow, and white of the target color gamut and X'Y'Z' values of red, green, blue, cyan, magenta, yellow, and white of the reference color gamut from the ICC profile, to calculate a reference color gamut applying matrix that converts the XYZ values to the X'Y'Z' values, to calculate RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix, and to generate the look-up table that includes the RGB values and the R'G'B' values mapped to the RGB values.

In example embodiments, the color gamut converting circuit may be configured to extract a gamma value of the display panel from the ICC profile, to determine a luminance level correction value based on the gamma value, and to reflect the luminance level correction value on the look-up table.

Therefore, a method of performing color gamut conversion according to example embodiments may perform the color gamut conversion on image data for implementing an image in real time using an ICC profile as a target color gamut of the image is changed by obtaining the ICC profile included in the image data, by extracting XYZ values of red, green, blue, cyan, magenta, yellow, and white of the target color gamut of the image and X'Y'Z' values of red, green, blue, cyan, magenta, yellow, and white of a reference color gamut of a display device from the ICC profile, by calculating a reference color gamut applying matrix that converts the XYZ values to the X'Y'Z' values, by calculating RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix, by generating a look-up table including the RGB values and the R'G'B' values mapped to the RGB values, and by compensating the image data based on the look-up table.

In addition, a display device according to example embodiments may provide a high-quality image to a viewer (or, user) by employing the method of performing the color gamut conversion.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
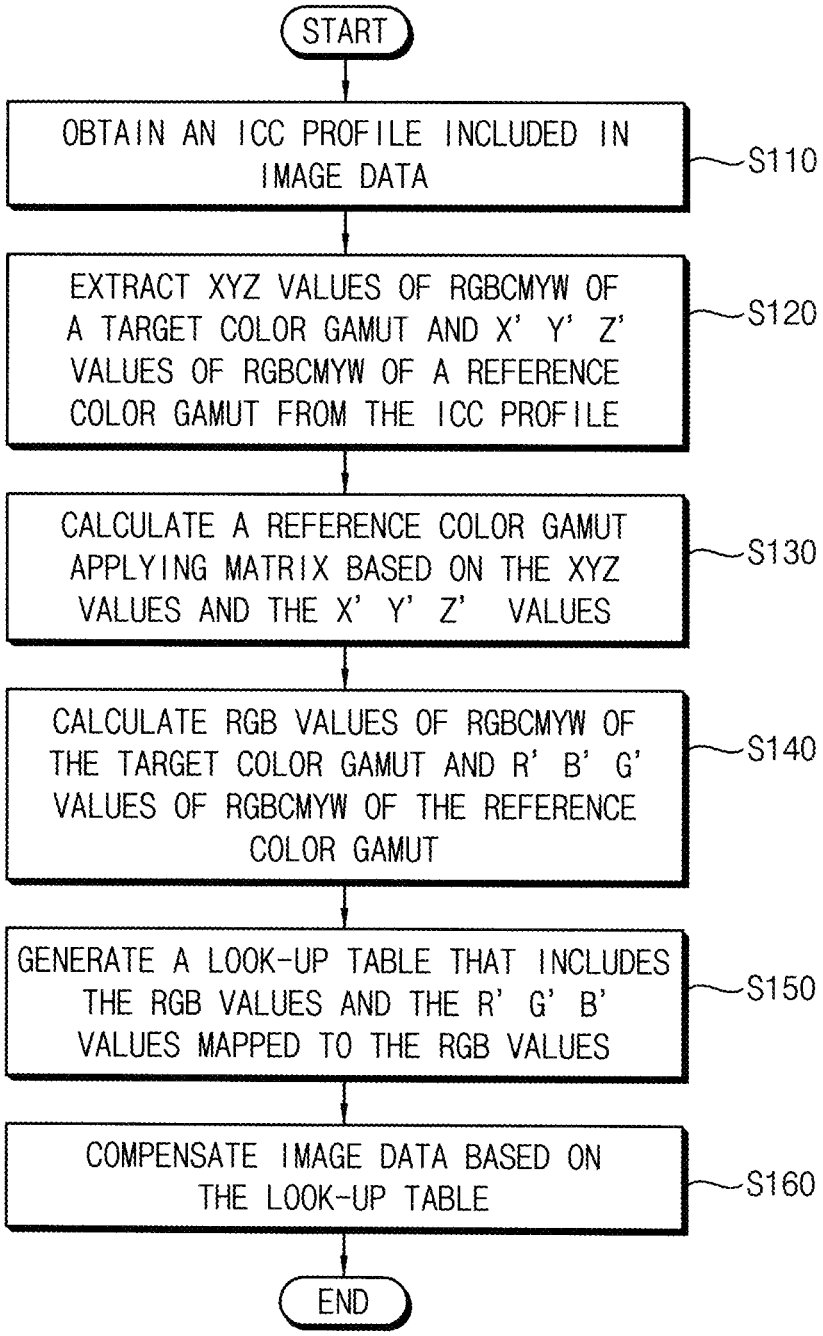
FIG. 1 is a flowchart illustrating a method of performing color gamut conversion according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of,"

when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Embodiments of the present invention relate to a method of performing color gamut conversion on image data based on a mapping between a reference color gamut of a display device and a target color gamut of an image which is generated with the target color gamut by a digital camera, a camcorder, etc.

Figure 2:
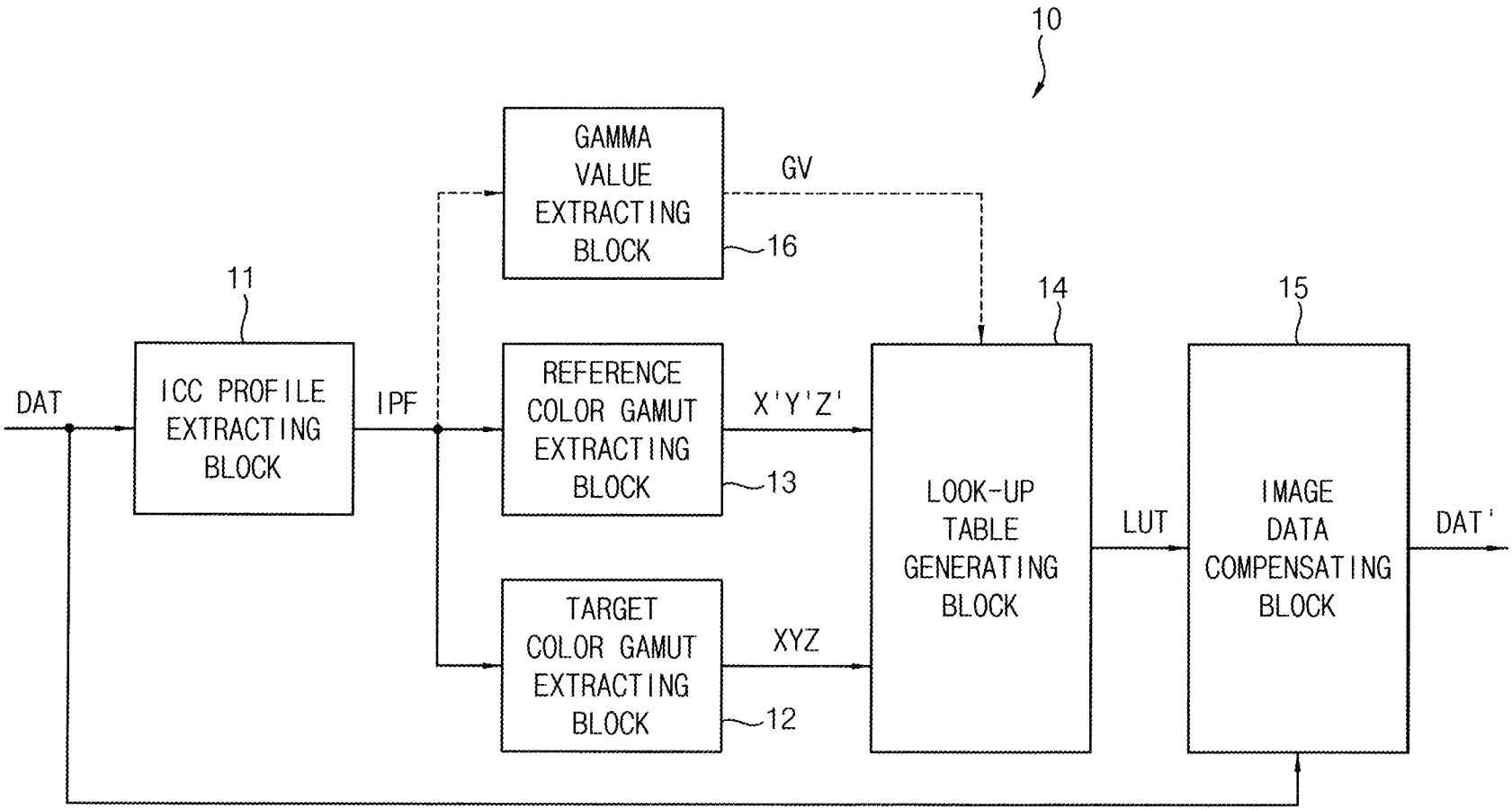
FIG. 2 is a block diagram illustrating an example color gamut converting circuit according to example embodiments.
Figure 3:
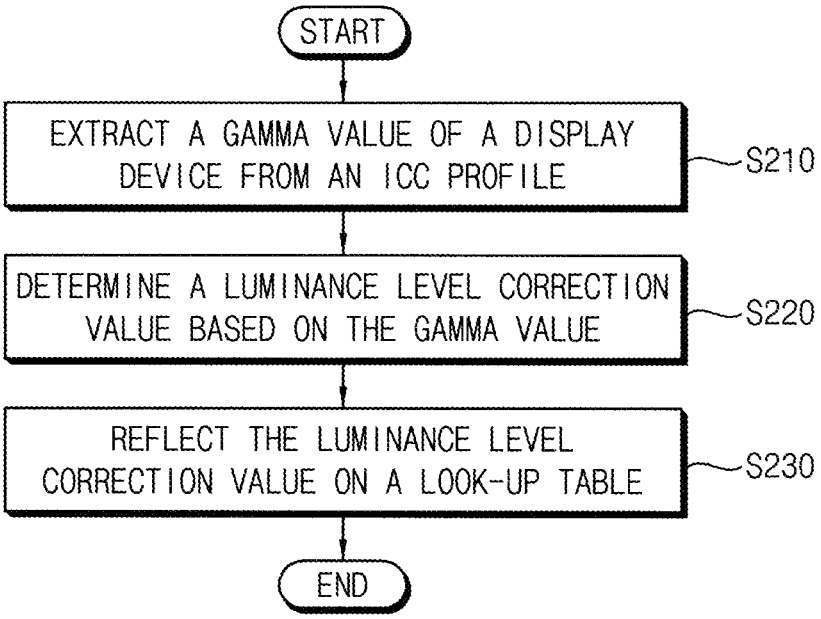
FIG. 3 is a block diagram for describing the method of FIG. 1.

FIG. 1 is a flowchart illustrating a method of performing color gamut conversion according to example embodiments, FIG. 2 is a block diagram illustrating an example color gamut converting circuit according to example embodiments, and FIG. 3 is a block diagram for describing the method of FIG. 1.

Referring to FIGS. 1 to 3, the method of FIG. 1 may obtain an international color consortium (ICC) profile IPF included in image data DAT (S110), may extract XYZ values XYZ of red, green, blue, cyan, magenta, yellow, and white of a target color gamut (or, referred to as a target color coordinate) of an image that the image data DAT implements and X'Y'Z' values X'Y'Z' of red, green, blue, cyan, magenta, yellow, and white of a reference color gamut (or, referred to as a reference color coordinate) of a display device from the ICC profile IPF (S120), may calculate a reference color gamut applying matrix that converts the XYZ values XYZ of red, green, blue, cyan, magenta, yellow, and white of the target color gamut to the X'Y'Z' values X'Y'Z' of red, green, blue, cyan, magenta, yellow, and white of the reference color gamut (S130), may calculate RGB values of red, green, blue, cyan, magenta, yellow, and white of the target color gamut and R'B'G' values of red, green, blue, cyan, magenta, yellow, and white of the reference color gamut using the reference color gamut applying matrix and an RGB-XYZ converting matrix (S140), may generate a look-up table LUT that includes the RGB values of red, green, blue, cyan, magenta, yellow, and white of the target color gamut and the R'G'B' values of red, green, blue, cyan, magenta, yellow, and white of the reference color gamut, which are mapped to the RGB values of red, green, blue, cyan, magenta, yellow, and white of the target color gamut (S150), and may compensate the image data DAT based on the look-up table LUT (S160).

Generally, a display device performs color gamut conversion on image data using a look-up table that includes a mapping between the reference color gamut of the display device and the target color gamut of an image generated by a digital camera, camcorder, etc. to display the image with a same (e.g. substantially exact) color. The look-up table is generated by converting RGB values of red, green, blue, cyan, magenta, yellow, and white of the target color gamut to tristimulus XYZ values. The tristimulus XYZ values are then converted to tristimulus X'Y'Z' values by applying the reference color gamut. The tristimulus X'Y'Z' values are then converted to R'G'B' values of red, green, blue, cyan, magenta, yellow, and white of the reference color gamut. The RGB values of red, green, blue, cyan, magenta, yellow, and white of the target color gamut are then mapped to the R'G'B' values of red, green, blue, cyan, magenta, yellow, and white of the reference color gamut. The above operation is generally performed by a high performance processor because it takes a long processing time to perform the above operation. Thus, a conventional display device cannot perform the color gamut conversion on the image data DAT in real time because it is difficult for the conventional display device to include the high performance processor. On the other hand, the method of FIG. 1 may allow the display device to perform the color gamut conversion on the image data DAT in real time as the target color gamut of the image is changed. In other words, the method of FIG. 1 may allow the display device to directly generate the look-up table LUT for the mapping between the reference color gamut of the display device and the target color gamut of the image using the ICC profile IPF. For example, as illustrated in FIG. 2, the method of FIG. 1 may be performed by a color gamut converting circuit 10 included in the display device.

The ICC profile IPF is a data file that describes color characteristics. The ICC profile includes textual descriptions and numerical data for colors. For example, the ICC profile IPF may include the XYZ values XYZ of red, green, blue, cyan, magenta, yellow, and white of the target color gamut of the image, the X'Y'Z' values X'Y'Z' of red, green, blue, cyan, magenta, yellow, and white of the reference target gamut of the display device, a gamma value GV of the display device, etc. Here, the ICC profile IPF may be included in the image data DAT. In an example embodiment, the target color gamut of the image may be a sRGB color gamut, an adobe RGB color gamut, or a DCI-P3 color gamut. Here, the ICC profile IPF is not limited to a specific file. That is, the ICC profile IPF should be interpreted as a color gamut information file that includes various color gamut information.

In some example embodiments, the method of FIG. 1 may obtain the ICC profile IPF included in the image data DAT (S110). For example, the method of FIG. 1 may extract the ICC profile IPF from the image data DAT that includes the ICC profile IPF. As described above, the method of FIG. 1 may be performed by the color gamut converting circuit 10 included in the display device. In this case, as illustrated in FIG. 2, an ICC profile extracting block 11 may perform the step S110 (i.e., may obtain the ICC profile IPF included in the image data DAT and may provide the ICC profile IPF to a target color gamut extracting block 12 and a reference color gamut extracting block 13). In some example embodiments, the display device may further include a gamma value extracting block 16. In these example embodiments, the ICC profile extracting block 11 may also provide the ICC profile IPF to the gamma value extracting block 16.

In some example embodiments, the method of FIG. 1 may extract the XYZ values XYZ of red, green, blue, cyan, magenta, yellow, and white of the target color gamut of the image that the image data DAT implements and the X'Y'Z' values X'Y'Z' of red, green, blue, cyan, magenta, yellow, and white of the reference color gamut of the display device from the ICC profile IPF (S120). For example, the method of FIG. 1 may extract fourteen values (i.e., the XYZ value XYZ of red of the target color gamut, the XYZ value XYZ of green of the target color gamut, the XYZ value XYZ of blue of the target color gamut, the XYZ value XYZ of cyan of the target color gamut, the XYZ value XYZ of magenta of the target color gamut, the XYZ value XYZ of yellow of the target color gamut, the XYZ value XYZ of white of the target color gamut, the X'Y'Z' value X'Y'Z' of red of the reference color gamut, the X'Y'Z' value X'Y'Z' of green of the reference color gamut, the X'Y'Z' value X'Y'Z' of blue of the reference color gamut, the X'Y'Z' value X'Y'Z' of cyan of the reference color gamut, the X'Y'Z' value X'Y'Z' of magenta of the reference color gamut, the X'Y'Z' value X'Y'Z' of yellow of the reference color gamut, and the X'Y'Z' value X'Y'Z' of white of the reference color gamut) from the ICC profile IPF. As described above, the method of FIG. 1 may be performed by the color gamut converting circuit 10 included in the display device. For example, as illustrated in FIG. 2, the target color gamut extracting block 12 and the reference color gamut extracting block 13 may perform the step S120. That is, the target color gamut extracting block 12 may extract the XYZ values XYZ of red, green, blue, cyan, magenta, yellow, and white of the target color gamut from the ICC profile IPF and may provide them to a look-up table generating block 14. In addition, the reference color gamut extracting block 13 may extract the X'Y'Z' values X'Y'Z' of red, green, blue, cyan, magenta, yellow, and white of the reference color gamut from the ICC profile IPF and may provide them to the look-up table generating block 14. Because the method of FIG. 1 extracts the XYZ values XYZ of red, green, blue, cyan, magenta, yellow, and white of the target color gamut and the X'Y'Z' values X'Y'Z' of red, green, blue, cyan, magenta, yellow, and white of the reference color gamut from the ICC profile IPF, the method of FIG. 1 may not perform an operation of converting the RGB values of red, green, blue, cyan, magenta, yellow, and white of the target color gamut of the image to the tristimulus XYZ values and an operation of converting the tristimulus XYZ values to the tristimulus X'Y'Z' values by applying the reference color gamut of the display device, where the operations are performed by a conventional color gamut converting technique.

In some example embodiments, the method of FIG. 1 may calculate the reference color gamut applying matrix that converts the XYZ values XYZ of red, green, blue, cyan, magenta, yellow, and white of the target color gamut to the X'Y'Z' values X'Y'Z' of red, green, blue, cyan, magenta, yellow, and white of the reference color gamut (S130). In an example embodiment, the method of FIG. 1 may calculate the reference color gamut applying matrix using [Matrix Equation 1] below. For example, the method of FIG. 1 may calculate the reference color gamut applying matrix by substituting the XYZ values XYZ of red, green, blue, cyan, magenta, yellow, and white of the target color gamut (i.e., seven values) and the X'Y'Z' values X'Y'Z' of red, green, blue, cyan, magenta, yellow, and white of the reference color gamut (i.e., seven values), which correspond to the XYZ values XYZ of red, green, blue, cyan, magenta, yellow, and white of the target color gamut, in the [Matrix Equation 1] below.

$$\begin{bmatrix} X' \\ Y' \\ Z' \end{bmatrix} = A \cdot \begin{bmatrix} X \\ Y \\ Z \end{bmatrix}, \qquad \text{Matrix Equation 1}$$

where A denotes the reference color gamut applying matrix.

In some example embodiments, when the reference color gamut applying matrix that converts the XYZ values XYZ of red, green, blue, cyan, magenta, yellow, and white of the target color gamut to the X'Y'Z' values X'Y'Z' of red, green, blue, cyan, magenta, yellow, and white of the reference color gamut is calculated, the method of FIG. 1 may calculate the RGB values of red, green, blue, cyan, magenta, yellow, and white of the target color gamut and the R'B'G' values of red, green, blue, cyan, magenta, yellow, and white of the reference color gamut using the reference color gamut applying matrix and the RGB-XYZ converting matrix (S140). For example, the RGB-XYZ converting matrix that converts RGB color coordinates to XYZ color coordinates may be expressed as [Matrix Equation 2] below. For example, the RGB-XYZ converting matrix may be a CAM02-matrix that is suggested in a color appearance model of the international commission on illumination (CIE). However, the RGB-XYZ converting matrix is not limited thereto.

$$\begin{bmatrix} X \\ Y \\ Z \end{bmatrix} = B \cdot \begin{bmatrix} R \\ G \\ B \end{bmatrix}, \qquad \text{Matrix Equation 2}$$

where B denotes the RGB-XYZ converting matrix.

For example, [Matrix Equation 3] below may be derived when the [Matrix Equation 2] is substituted into the [Matrix Equation 1]. Thus, the method of FIG. 1 may calculate the RGB values of red, green, blue, cyan, magenta, yellow, and white of the target color gamut and the R'G'B' values of red, green, blue, cyan, magenta, yellow, and white of the reference color gamut, which correspond to the R'G'B' values of red, green, blue, cyan, magenta, yellow, and white of the target color gamut, using the [Matrix Equation 3] below.

$$\begin{bmatrix} R' \\ G' \\ B' \end{bmatrix} = B^{-1} \cdot A \cdot B \cdot \begin{bmatrix} R \\ G \\ B \end{bmatrix} \quad \text{Matrix Equation 3}$$

When the RGB values of red, green, blue, cyan, magenta, yellow, and white of the target color gamut and the R'G'B' values of red, green, blue, cyan, magenta, yellow, and white of the reference color gamut, which correspond to the RGB values of red, green, blue, cyan, magenta, yellow, and white of the target color gamut, are calculated, the method of FIG. 1 may generate the look-up table LUT that includes the RGB values of red, green, blue, cyan, magenta, yellow, and white of the target color gamut and the R'G'B' values of red, green, blue, cyan, magenta, yellow, and white of the reference color gamut, which are mapped to the RGB values of red, green, blue, cyan, magenta, yellow, and white of the target color gamut (S150). That is, the look-up table LUT may include seven pairs of mappings (i.e., the mapping between the RGB values of red, green, blue, cyan, magenta, yellow, and white of the target color gamut and the R'G'B' values of red, green, blue, cyan, magenta, yellow, and white of the reference color gamut). Thus, the method of FIG. 1 may calculate at least one pair that is not included in the look-up table LUT by performing an interpolation on the seven pairs of the mappings when compensating the image data DAT. In an example embodiment, the look-up table LUT may further include additional mappings that are generated by performing the interpolation on the seven pairs of the mappings (i.e., the mapping between the RGB values of red, green, blue, cyan, magenta, yellow, and white of the target color gamut and the R'G'B' values of red, green, blue, cyan, magenta, yellow, and white of the reference color gamut). In this case, the method of FIG. 1 may not calculate at least one pair that is not included in the look-up table LUT when compensating the image data DAT. As described above, the method of FIG. 1 may be performed by the color gamut converting circuit 10 included in the display device. In some example embodiments, as illustrated in FIG. 2, the look-up table generating block 14 may perform all the steps S130, S140, and S150.

In an example embodiment, the XYZ values XYZ of red, green, blue, cyan, magenta, yellow, and white of the target color gamut may correspond to maximum chroma red, maximum chroma green, maximum chroma blue, maximum chroma cyan, maximum chroma magenta, maximum chroma yellow, and maximum chroma white of the target color gamut, and thus corresponding X'Y'Z' values X'Y'Z' of red, green, blue, cyan, magenta, yellow, and white of the reference color gamut may correspond to maximum chroma red, maximum chroma green, maximum chroma blue, maximum chroma cyan, maximum chroma magenta, maximum chroma yellow, and maximum chroma white of the reference color gamut. In this case, the RGB values of red, green, blue, cyan, magenta, yellow, and white of the target color gamut may correspond to the maximum chroma red, the maximum chroma green, the maximum chroma blue, the maximum chroma cyan, the maximum chroma magenta, the maximum chroma yellow, and the maximum chroma white of the target color gamut, and thus corresponding (i.e., mapped to the RGB values) R'G'B' values of red, green, blue, cyan, magenta, yellow, and white of the reference color gamut may be for the maximum chroma red, the maximum chroma green, the maximum chroma blue, the maximum chroma cyan, the maximum chroma magenta, the maximum chroma yellow, and the maximum chroma white of the reference color gamut.

The method of FIG. 1 may generate compensated image data DAT' by compensating the image data DAT based on the look-up table LUT (S160). Thus, the display device may display the image based on the compensated image data DAT'. As described above, the method of FIG. 1 may be performed by the color gamut converting circuit 10 included in the display device. In this case, as illustrated in FIG. 2, an image data compensating block 15 may perform the step S160 (i.e., may receive the look-up table LUT from the look-up table generating block 14 and may generate the compensated image data DAT' by compensating the image data DAT based on the look-up table LUT).

In example embodiments, as illustrated in FIG. 3, the method of FIG. 1 may further perform luminance level correction on the look-up table LUT based on the gamma value GV of the display device. For example, the method of FIG. 1 may extract the gamma value GV of the display device from the ICC profile IPF (S210) when the ICC profile IPF included in the image data DAT is obtained, may determine a luminance level correction value based on the gamma value GV of the display device (S220), and may reflect the luminance level correction value on the look-up table LUT (S230). For example, the method of FIG. 1 may reflect the luminance level correction value on the look-up table LUT by reflecting the luminance level correction value that is determined based on the gamma value GV of the display device, which are extracted from the ICC profile IPF, on the reference color gamut applying matrix that converts the XYZ values XYZ of red, green, blue, cyan, magenta, yellow, and white of the target color gamut to the X'Y'Z' values X'Y'Z' of red, green, blue, cyan, magenta, yellow, and white of the reference color gamut. As described above, the method of FIG. 1 may be performed by the color gamut converting circuit 10 included in the display device. For example, as illustrated in FIG. 2, a gamma value extracting block 16 may perform the step S230 (i.e., may receive the ICC profile IPF from the ICC profile extracting block 11, may determine the luminance level correction value based on the gamma value GV of the display device, which are extracted from the ICC profile IPF, and provide the luminance level correction value to the look-up table generating block 14 to reflect the luminance level correction value on the look-up table LUT).

In some example embodiments, the method of FIG. 1 may perform the color gamut conversion on the image data DAT in real time using the ICC profile IPF as the target color gamut of the image that the image data DAT implements is changed by obtaining the ICC profile IPF included in the image data DAT, by extracting the XYZ values XYZ of red, green, blue, cyan, magenta, yellow, and white of the target color gamut and the X'Y'Z' values X'Y'Z' of red, green, blue, cyan, magenta, yellow, and white of the reference color gamut from the ICC profile IPF, by calculating the reference color gamut applying matrix that converts the XYZ values XYZ of red, green, blue, cyan, magenta, yellow, and white of the target color gamut to the X'Y'Z' values X'Y'Z' of red, green, blue, cyan, magenta, yellow, and white of the reference color gamut, by calculating the RGB values RGB of red, green, blue, cyan, magenta, yellow, and white of target color gamut and the R'G'B' values R'G'B' of red, green, blue, cyan, magenta, yellow, and white of the reference color gamut using the reference color gamut applying matrix and the RGB-XYZ converting matrix, by generating the look-up table LUT that includes the RGB values RGB of red, green, blue, cyan, magenta, yellow, and white of target color gamut and the R'G'B' values R'G'B' of red, green, blue, cyan, magenta, yellow, and white of the reference color gamut that are mapped to the RGB values RGB of red, green, blue, cyan, magenta, yellow, and white of target color gamut, and by compensating the image data DAT that implements the image based on the look-up table LUT.

Figure 4:
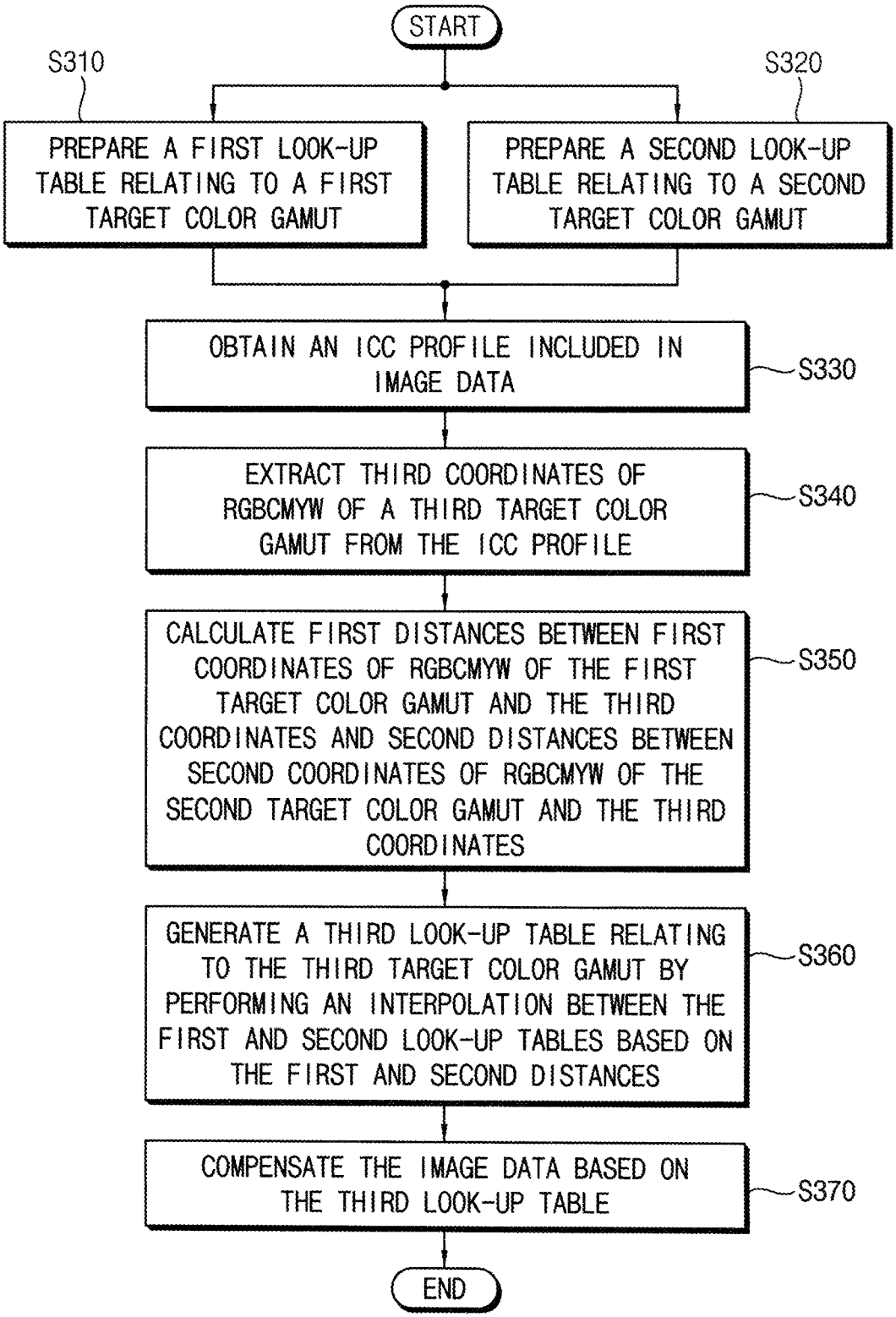
FIG. 4 is a flowchart illustrating a method of performing color gamut conversion according to example embodiments.
Figure 5:
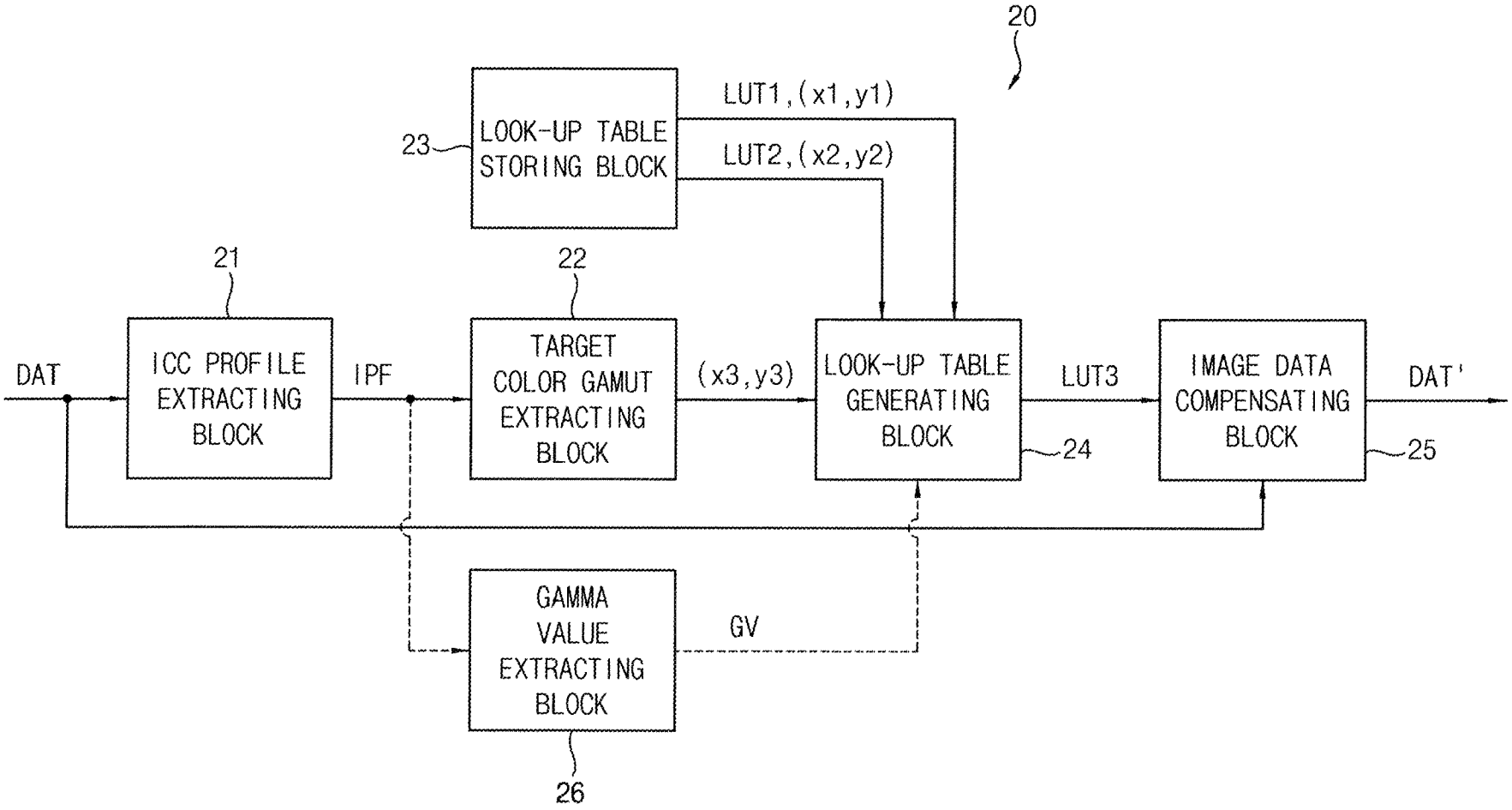
FIG. 5 is a block diagram illustrating an example color gamut converting circuit according to example embodiments.
Figure 6:
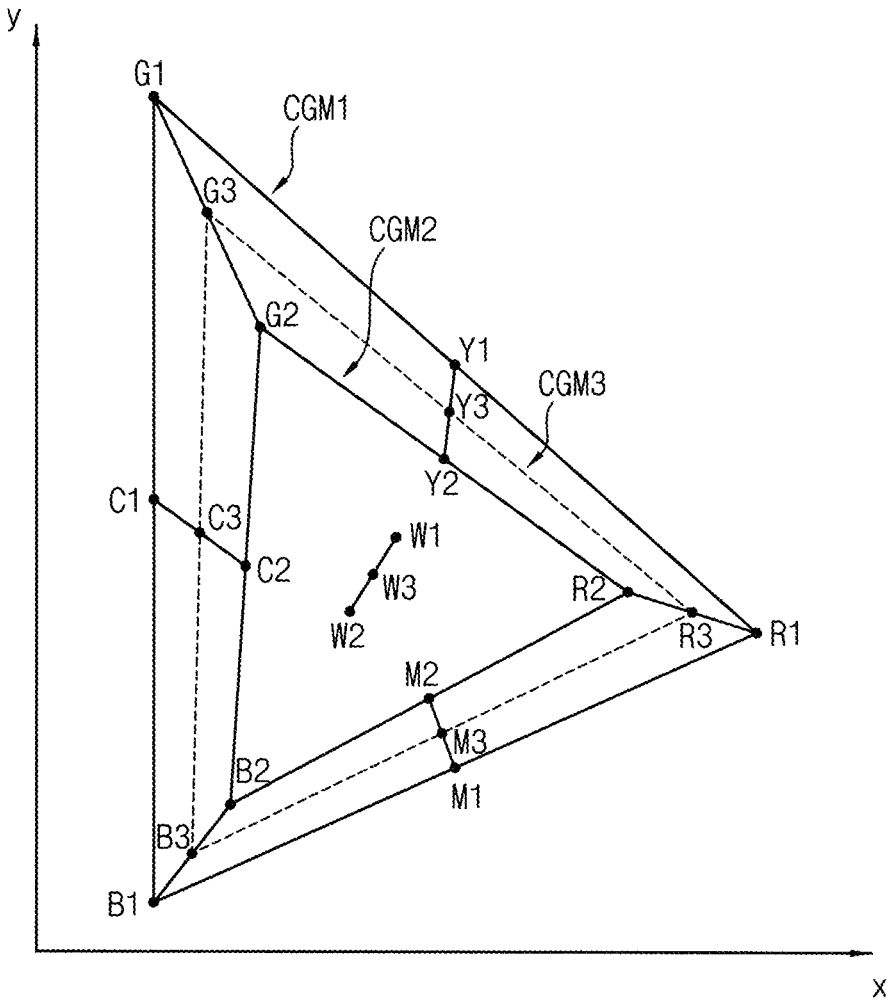
FIG. 6 is a diagram illustrating an example in which the method of FIG. 4 performs a linear interpolation.

FIG. 4 is a flowchart illustrating a method of performing color gamut conversion according to example embodiments, FIG. 5 is a block diagram illustrating a color gamut converting circuit according to example embodiments, and FIG. 6 is a diagram illustrating an example in which the method of FIG. 4 performs a linear interpolation.

Referring to FIGS. 4 to 6, the method of FIG. 4 may prepare a first look-up table LUT1 that includes R1G1B1 values of red, green, blue, cyan, magenta, yellow, and white of a first target color gamut CGM1 and R1'G1'B1' values of red, green, blue, cyan, magenta, yellow, and white of a reference color gamut that are mapped to the R1G1B1 values (S310), may prepare a second look-up table LUT2 that includes R2G2B2 values of red, green, blue, cyan, magenta, yellow, and white of a second target color gamut CGM2 and R2'G2'B2' values of red, green, blue, cyan, magenta, yellow, and white of a reference color gamut that are mapped to the R2G2B2 values (S320), may obtain an ICC profile IPF included in image data DAT (S330), may extract third coordinates (x3, y3) of red, green, blue, cyan, magenta, yellow, and white of a third target color gamut CGM3 of an image that the image data DAT implements from the ICC profile IPF (S340), may calculate first distances between the first coordinates (x1, y1) of red, green, blue, cyan, magenta, yellow, and white of the first target color gamut CGM1 and the third coordinates (x3, y3) of red, green, blue, cyan, magenta, yellow, and white of the third target color gamut CGM3 and second distances between second coordinates (x2, y2) of red, green, blue, cyan, magenta, yellow, and white of the second target color gamut CGM2 and the third coordinates (x3, y3) of red, green, blue, cyan, magenta, yellow, and white of the third target color gamut CGM3 (S350), may generate a third look-up table LUT3 that includes R3G3B3 values of red, green, blue, cyan, magenta, yellow, and white of the third target color gamut CGM3 and R3'G3'B3' values of red, green, blue, cyan, magenta, yellow, and white of the reference color gamut that are mapped to the R3G3B3 values by performing an interpolation between the first look-up table LUT1 and the second look-up table LUT2 based on the first distances and the second distances (S360), and may compensate the image data DAT based on the third look-up table LUT3 (S370). For example, as illustrated in FIG. 5, the method of FIG. 4 may be performed by a color gamut converting circuit 20 included in a display device.

In some example embodiments, the method of FIG. 4 may prepare the first look-up table LUT1 that includes the R1G1B1 values of red, green, blue, cyan, magenta, yellow, and white of the first target color gamut CGM1 and the R1'G1'B1' values of red, green, blue, cyan, magenta, yellow, and white of the reference color gamut that are mapped to the R1G1B1 values (S310) and may prepare the second look-up table LUT2 that includes the R2G2B2 values of red, green, blue, cyan, magenta, yellow, and white of the second target color gamut CGM2 and the R2'G2'B2' values of red, green, blue, cyan, magenta, yellow, and white of the reference color gamut that are mapped to the R2G2B2 values (S320). As described above, the method of FIG. 4 may be performed by the color gamut converting circuit 20 included in the display device. In this case, as illustrated in FIG. 5, a look-up table storing block 23 may perform the steps S310 and S320. That is, the look-up table storing block 23 may store the first look-up table LUT1 relating to the first target color gamut CGM1 and the second look-up table LUT2 relating to the second target color gamut CGM2 and may provide the first look-up table LUT1 relating to the first target color gamut CGM1 and the second look-up table LUT2 relating to the second target color gamut CGM2 to a look-up table generating block 24 to generate the third look-up table LUT3 relating to the third target color gamut CGM3. Here, the look-up table storing block 23 may also provide the first coordinates (x1, y1) of red, green, blue, cyan, magenta, yellow, and white of the first target color gamut CGM1 and the second coordinates (x2, y2) of red, green, blue, cyan, magenta, yellow, and white of the second target color gamut CGM2 to the look-up table generating block 24. For example, the look-up table storing block 23 may be implemented as a memory device.

In addition, the method of FIG. 4 may obtain the ICC profile IPF included in the image data DAT (S330). That is, the method of FIG. 4 may extract the ICC profile IPF from the image data DAT that includes the ICC profile IPF. As described above, the method of FIG. 4 may be performed by the color gamut converting circuit 20 included in the display device. In this case, as illustrated in FIG. 5, an ICC profile extracting block 21 may perform the step S330. In other words, the ICC profile extracting block 21 may obtain the ICC profile IPF included in the image data DAT and may provide the ICC profile IPF to a target color gamut extracting block 22. In some example embodiments, when the display device includes a gamma value extracting block 26, the ICC profile extracting block 21 may provide the ICC profile IPF to the gamma value extracting block 26. Although it is illustrated in FIG. 4 that the steps S310 and S320 are performed prior to the step S330, the present inventive concept is not limited thereto. Thus, for example, the step S330 may be performed prior to the steps S310 and S320.

Subsequently, the method of FIG. 4 may extract the third coordinates (x3, y3) of red, green, blue, cyan, magenta, yellow, and white of the third target color gamut CGM3 of the image that the image data DAT implements from the ICC profile IPF (S340). In other words, seven values (i.e., the third coordinate (x3, y3) of red of the third target color gamut CGM3, the third coordinate (x3, y3) of green of the third target color gamut CGM3, the third coordinate (x3, y3) of blue of the third target color gamut CGM3, the third coordinate (x3, y3) of cyan of the third target color gamut CGM3, the third coordinate (x3, y3) of magenta of the third target color gamut CGM3, the third coordinate (x3, y3) of yellow of the third target color gamut CGM3, and the third coordinate (x3, y3) of white of the third target color gamut CGM3) may be extracted from the ICC profile IPF. In some example embodiments, the method of FIG. 4 may not extract the third coordinate (x3, y3) of white of the third target color gamut CGM3. As described above, the method of FIG. 4 may be performed by the color gamut converting circuit 20 included in the display device. In this case, as illustrated in FIG. 5, the target color gamut extracting block 22 may perform the step S340. For example, the target color gamut extracting block 22 may extract the third coordinates (x3, y3) of red, green, blue, cyan, magenta, yellow, and white of the third target color gamut CGM3 from the ICC profile IPF and may provide the third coordinates (x3, y3) of red, green, blue, cyan, magenta, yellow, and white of the third target color gamut CGM3 to the look-up table generating block 24.

Next, the method of FIG. 4 may calculate the first distances between the first coordinates (x1, y1) of red, green, blue, cyan, magenta, yellow, and white of the first target color gamut CGM1 and the third coordinates (x3, y3) of red, green, blue, cyan, magenta, yellow, and white of the third target color gamut CGM3 and the second distances between the second coordinates (x2, y2) of red, green, blue, cyan, magenta, yellow, and white of the second target color gamut CGM2 and the third coordinates (x3, y3) of red, green, blue, cyan, magenta, yellow, and white of the third target color gamut CGM3 (S350). Here, the first distances between the first coordinates (x1, y1) of red, green, blue, cyan, magenta, yellow, and white of the first target color gamut CGM1 and the third coordinates (x3, y3) of red, green, blue, cyan, magenta, yellow, and white of the third target color gamut CGM3 may be calculated using [Equation 1] below, and the second distances between the second coordinates (x2, y2) of red, green, blue, cyan, magenta, yellow, and white of the second target color gamut CGM2 and the third coordinates (x3, y3) of red, green, blue, cyan, magenta, yellow, and white of the third target color gamut CGM3 may be calculated using [Equation 2] below.

$$D1=\sqrt{(x3-x1)^2+(y3-y1)^2} \quad \text{Equation 1}$$

where D1 denotes the first distances between the first coordinates and the third coordinates, (x3, y3) denotes the third coordinates, and (x1, y1) denotes the first coordinates.

$$D2=\sqrt{(x3-x2)^2+(y3-y2)^2} \quad \text{Equation 2}$$

where D2 denotes the second distances between the second coordinates and the third coordinates, (x3, y3) denotes the third coordinates, and (x2, y2) denotes the second coordinates.

Subsequently, the method of FIG. 4 may generate the third look-up table LUT3 that includes the R3G3B3 values of red, green, blue, cyan, magenta, yellow, and white of the third target color gamut CGM3 and the R3'G3'B3' values of red, green, blue, cyan, magenta, yellow, and white of the reference color gamut that are mapped to the R3G3B3 values by performing the interpolation between the first look-up table LUT1 relating to the first target color gamut CGM1 and the second look-up table LUT2 relating to the second target color gamut CGM2 based on the first distances between the first coordinates (x1, y1) of red, green, blue, cyan, magenta, yellow, and white of the first target color gamut CGM1 and the third coordinates (x3, y3) of red, green, blue, cyan, magenta, yellow, and white of the third target color gamut CGM3 and the second distances between the second coordinates (x2, y2) of red, green, blue, cyan, magenta, yellow, and white of the second target color gamut CGM2 and the third coordinates (x3, y3) of red, green, blue, cyan, magenta, yellow, and white of the third target color gamut CGM3 (S360). In an example embodiment, the interpolation may be a linear interpolation. In this case, the R3G3B3 values of red, green, blue, cyan, magenta, yellow, and white of the third target color gamut CGM3 and the R3'G3'B3' values of red, green, blue, cyan, magenta, yellow, and white of the reference color gamut that are mapped to the R3G3B3 values may be calculated using [Equation 3] below.

$$R_3 = \frac{(R_1 \times D2) + (R_2 \times D1)}{(D1 + D2)} \quad \text{Equation 3}$$

$$R'_3 = \frac{(R'_1 \times D2) + (R'_2 \times D1)}{(D1 + D2)}$$

-continued $$G_3 = \frac{(G_1 \times D2) + (G_2 \times D1)}{(D1 + D2)}$$

$$G'_3 = \frac{(G'_1 \times D2) + (G'_2 \times D1)}{(D1 + D2)}$$

$$B_3 = \frac{(B_1 \times D2) + (B_2 \times D1)}{(D1 + D2)}$$

$$B'_3 = \frac{(B'_1 \times D2) + (B'_2 \times D1)}{(D1 + D2)},$$

where R1 denotes the R1 values, G1 denotes the G1 values, B1 denotes the B1 values, R2 denotes the R2 values, G2 denotes the G2 values, B2 denotes the B2 values, R3 denotes the R3 values, G3 denotes the G3 values, B3 denotes the B3 values, R1' denotes the R1' values, G1' denotes the G1' values, B1' denotes the B1' values, R2' denotes the R2' values, G2' denotes the G2' values, B2' denotes the B2' values, R3' denotes the R3' values, G3' denotes the G3' values, B3' denotes the B3' values, D1 denotes the first distances between the first coordinates (x1, y1) and the third coordinates (x3, y3), and D2 denotes the second distances between the second coordinates (x2, y2) and the third coordinates (x3, y3).

In an example embodiment, the third look-up table LUT3 may include seven pairs of mappings (i.e., the mappings between the R3G3B3 values of red, green, blue, cyan, magenta, yellow, and white of the third target color gamut CGM3 and the R3'G3'B3' values of red, green, blue, cyan, magenta, yellow, and white of the reference color gamut). Thus, pairs of mappings that are not included in the third look-up table LUT3 may be calculated by performing interpolations on the seven pairs of mappings when the image data DAT is compensated. In an example embodiment, the third look-up table LUT3 may further include additional mappings generated by performing the interpolations on the seven pairs of mappings (i.e., the mappings between the R3G3B3 values of red, green, blue, cyan, magenta, yellow, and white of the third target color gamut CGM3 and the R3'G3'B3' values of red, green, blue, cyan, magenta, yellow, and white of the reference color gamut). In this case, the pairs of mappings that are not included in the third look-up table LUT3 may not be calculated when the image data DAT is compensated. As described above, the method of FIG. 4 may be performed by the color gamut converting circuit 20 included in the display device. In this case, as illustrated in FIG. 5, the look-up table generating block 24 may perform the steps S350 and S360.

In an example embodiment, the R1G1B1 values of red, green, blue, cyan, magenta, yellow, and white of the first target color gamut CGM1 may be for maximum chroma red, maximum chroma green, maximum chroma blue, maximum chroma cyan, maximum chroma magenta, maximum chroma yellow, and maximum chroma white of the first target color gamut CGM1, and thus corresponding R1'G1'B1' values of red, green, blue, cyan, magenta, yellow, and white of the reference color gamut may be for maximum chroma red, maximum chroma green, maximum chroma blue, maximum chroma cyan, maximum chroma magenta, maximum chroma yellow, and maximum chroma white of the reference color gamut. Similarly, the R2G2B2 values of red, green, blue, cyan, magenta, yellow, and white of the second target color gamut CGM2 may be for maximum chroma red, maximum chroma green, maximum chroma blue, maximum chroma cyan, maximum chroma magenta, maximum chroma yellow, and maximum chroma white of the second target color gamut CGM2, and thus the corresponding R2'G2'B2' values of red, green, blue, cyan, magenta, yellow, and white of the reference color gamut may be for maximum chroma red, maximum chroma green, maximum chroma blue, maximum chroma cyan, maximum chroma magenta, maximum chroma yellow, and maximum chroma white of the reference color gamut. Hence, the R3G3B3 values of red, green, blue, cyan, magenta, yellow, and white of the third target color gamut CGM3 may be for maximum chroma red, maximum chroma green, maximum chroma blue, maximum chroma cyan, maximum chroma magenta, maximum chroma yellow, and maximum chroma white of the third target color gamut CGM3, and thus the corresponding R3'G3'B3' values of red, green, blue, cyan, magenta, yellow, and white of the reference color gamut may be for maximum chroma red, maximum chroma green, maximum chroma blue, maximum chroma cyan, maximum chroma magenta, maximum chroma yellow, and maximum chroma white of the reference color gamut.

Next, the method of FIG. 4 may compensate the image data DAT based on the third look-up table LUT3 (S370) to generate compensated image data DAT'. Thus, the display device may display the image based on the compensated image data DAT'. As described above, the method of FIG. 4 may be performed by the color gamut converting circuit 20 included in the display device. In this case, as illustrated in FIG. 5, an image data compensating block 25 may perform the step S370. That is, the image data compensating block 25 may receive the third look-up table LUT3 from the look-up table generating block 24 and may generate the compensated image data DAT' by compensating the image data DAT based on the third look-up table LUT3. In brief, the method of FIG. 4 may perform the color gamut conversion on the image data DAT in real time using the ICC profile IPF as the target color gamut of the image is changed. In some example embodiments, the method of FIG. 4 may further perform luminance level correction on the third look-up table LUT3 based on the gamma value GV of the display device. In an example embodiment, the method of FIG. 4 may obtain the ICC profile IPF included in the image data DAT, may extract the gamma value GV of the display device from the ICC profile IPF, may determine a luminance level correction value based on the gamma value GV of the display device, and may reflect the luminance level correction value on the third look-up table LUT3. In an example embodiment, as illustrated in FIG. 5, a gamma value extracting block 26 may receive the ICC profile IPF from the ICC profile extracting block 21, may determine the luminance level correction value based on the gamma value GV of the display device that are extracted from the ICC profile IPF, and may provide the luminance level correction value to the look-up table generating block 24 to reflect the luminance level correction value on the third look-up table LUT3.

Figure 7:
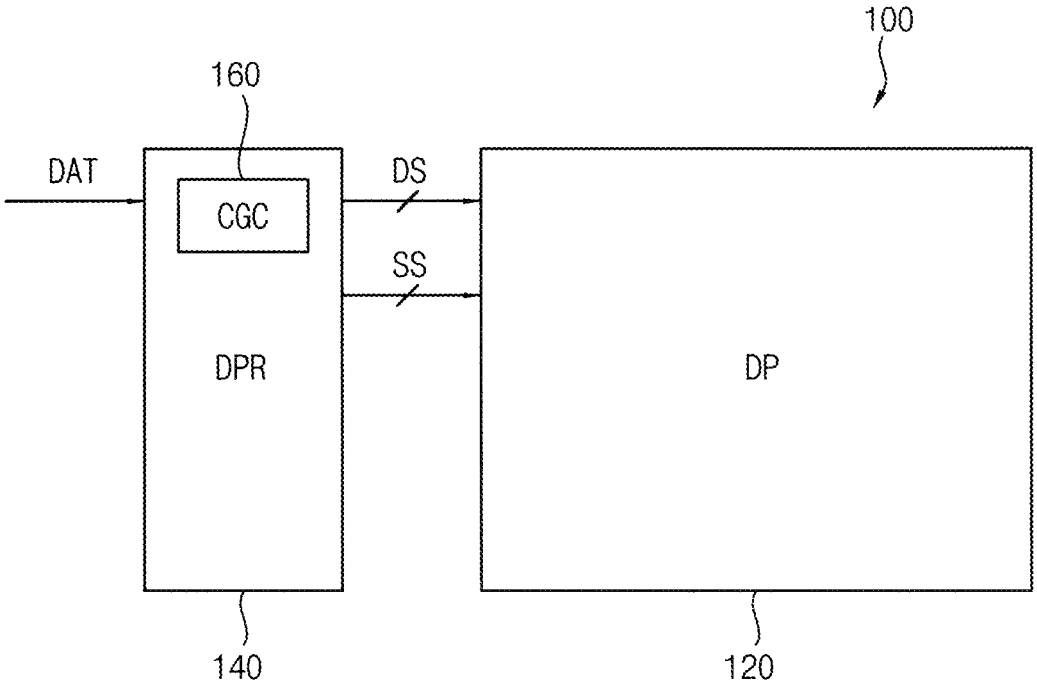
FIG. 7 is a block diagram illustrating a display device according to example embodiments.

FIG. 7 is a block diagram illustrating a display device according to example embodiments.

Referring to FIG. 7, the display device 100 may include a display panel 120, a display panel driving circuit 140, and a color gamut converting circuit 160. Here, the display device 100 may be an organic light emitting display (OLED) device or a liquid crystal display (LCD) device. However, the display device 100 is not limited thereto.

The display panel 120 may include a plurality of pixels. In the display panel 120, the pixels may be arranged in a matrix form. The display panel driving circuit 140 may drive the display panel 120. In an example embodiment, the display panel driving circuit 140 may include a scan driver, a data driver, and a timing controller. The display panel 120 may be connected to the scan driver via scan-lines. The display panel 120 may be connected to the data driver via data-lines. The scan driver may provide a scan signal SS to the display panel 120 via the scan-lines. The data driver may provide a data signal DS to the display panel 120 via the data-lines. The timing controller may control the scan driver and the data driver. In another example embodiment, when the display device 100 is the organic light emitting display device, the display panel driving circuit 140 may include a scan driver, a data driver, an emission controller, and a timing controller. In this case, the display panel 120 may also be connected to the emission controller via emission control-lines. The emission controller may provide an emission control signal to the display panel 120 via the emission control-lines. Because the above structure of the display panel driving circuit 140 is an example, components included in the display panel driving circuit 140 are not limited thereto.

The color gamut converting circuit 160 may extract an ICC profile included in image data DAT, may generate, using the ICC profile, a look-up table for a mapping between a reference color gamut of the display panel 120 and a target color gamut of an image that the image data DAT implements, and may compensate the image data DAT based on the look-up table. In an example embodiment, the color gamut converting circuit 160 may extract XYZ values of red, green, blue, cyan, magenta, yellow, and white of the target color gamut and X'Y'Z' values of red, green, blue, cyan, magenta, yellow, and white of the reference color gamut from the ICC profile, may calculate a reference color gamut applying matrix that converts the XYZ values to the X'Y'Z' values, may calculate RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix, and may generate the look-up table that includes the RGB values and the R'G'B' values mapped to the RGB values. In another example embodiment, the color gamut converting circuit 160 may prepare a first look-up table relating to a first target color gamut and a second look-up table relating to a second target color gamut, may extract third coordinates of red, green, blue, cyan, magenta, yellow, and white of a third target color gamut of an image that the image data DAT implements from the ICC profile, and may generate a look-up table (i.e., a third look-up table) that includes R3G3B3 values of red, green, blue, cyan, magenta, yellow, and white of the third target color gamut and R3'G3'B3' values of red, green, blue, cyan, magenta, yellow, and white of the reference color gamut, which are mapped to the R3G3B3 values of red, green, blue, cyan, magenta, yellow, and white of the third target color gamut by perform an interpolation between the first look-up table relating to the first target color gamut and the second look-up table relating to the second target color gamut based on first distances between first coordinates of red, green, blue, cyan, magenta, yellow, and white of the first target color gamut and the third coordinates and second distances between second coordinates of red, green, blue, cyan, magenta, yellow, and white of the second target color gamut and the third coordinates.

In some example embodiments, the color gamut converting circuit 160 may extract gamma value of the display panel 120 from the ICC profile, may determine a luminance level correction value based on the gamma value of the display panel 120, and may reflect the luminance level correction value to the look-up table. In this case, the color gamut converting circuit 160 may perform the color gamut conversion on the image data DAT more accurately. In an example embodiment, as illustrated in FIG. 7, the color gamut converting circuit 160 may be implemented in the display panel driving circuit 140. For example, the color gamut converting circuit 160 may be located in the timing controller of the display panel driving circuit 140. In another example embodiment, the color gamut converting circuit 160 may be implemented externally to the display panel driving circuit 140. In this case, the color gamut converting circuit 160 may be connected to the display panel driving circuit 140 (e.g., the timing controller of the display panel driving circuit 140). In brief, the display device 100 may use a relatively short processing time to perform the color gamut conversion and thus may perform the color gamut conversion at high speed without using an external high performance processor by performing, using the ICC profile, the color gamut conversion on the image data DAT based on the mapping between the reference color gamut of the display panel 120 and the target color gamut of the image that the image data DAT implements. In other words, the display device 100 may not perform an operation of converting the RGB values of red, green, blue, cyan, magenta, yellow, and white of the target color gamut of the image that the image data DAT implements to the tristimulus XYZ values and an operation of converting the tristimulus XYZ values to the tristimulus X'Y'Z' values by applying the reference color gamut of the display panel 120. As a result, the display device 100 may perform the color gamut conversion on the image data DAT in real time using the ICC profile as the target color gamut of the image is changed.

Figure 8:
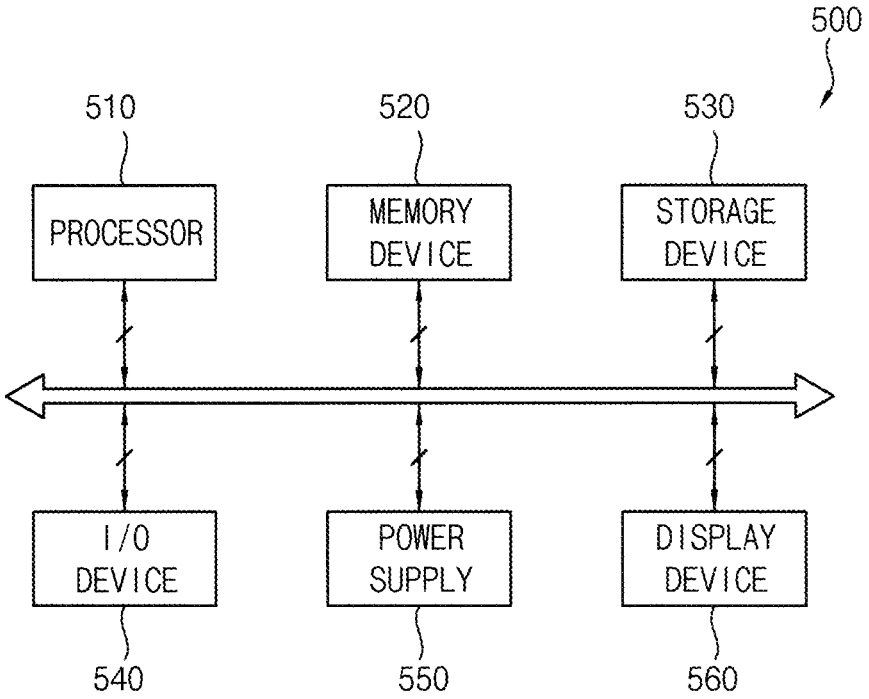
FIG. 8 is a block diagram illustrating an electronic device according to example embodiments.
Figure 9:
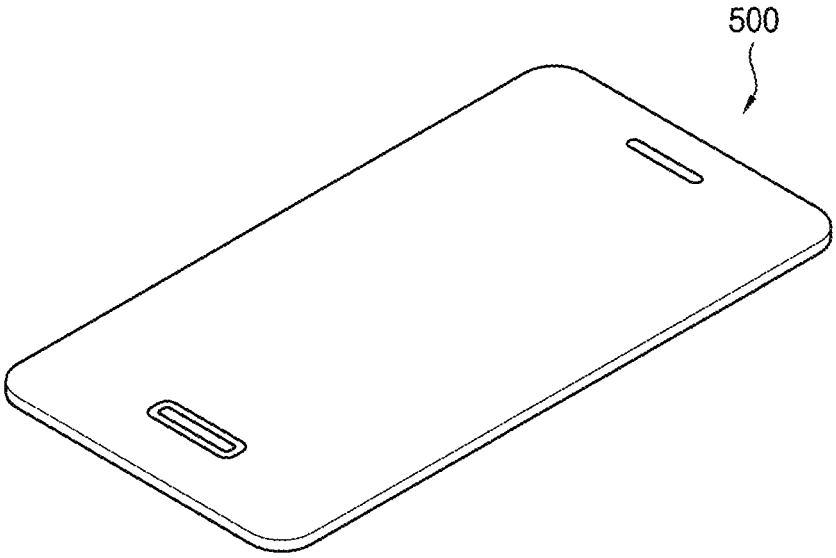
FIG. 9 is a diagram illustrating an example in which the electronic device of FIG. 8 is implemented as a smart phone.
Figure 10:
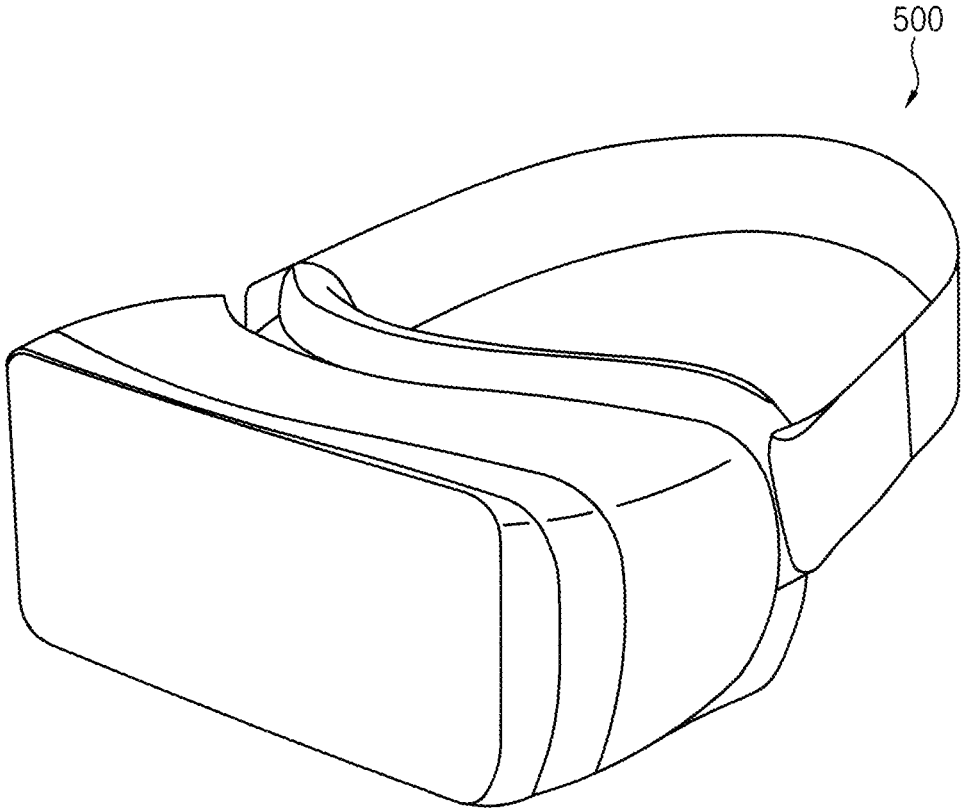
FIG. 10 is a diagram illustrating an example in which the electronic device of FIG. 8 is implemented as a head mounted display device.

FIG. 8 is a block diagram illustrating an electronic device according to example embodiments, FIG. 9 is a diagram illustrating an example in which the electronic device of FIG. 8 is implemented as a smart phone, and FIG. 10 is a diagram illustrating an example in which the electronic device of FIG. 8 is implemented as a head mounted display (HMD) device.

Referring to FIGS. 8 to 10, the electronic device 500 may include a processor 510, a memory device 520, a storage device 530, an input/output (I/O) device 540, a power supply 550, and a display device 560. Here, the display device 560 may be the display device 100 of FIG. 7. The electronic device 500 may further include a plurality of ports for communicating with a video card, a sound card, a memory card, a universal serial bus (USB) device, other electronic devices, etc. In an example embodiment, as illustrated in FIG. 9, the electronic device 500 may be implemented as a smart phone. In another example embodiment, as illustrated in FIG. 10, the electronic device 500 may be implemented as a head mounted display device. However, the electronic device 500 is not limited thereto. For example, the electronic device 500 may be implemented as a computer monitor, a laptop, a digital camera, a cellular phone, a smart pad, a smart watch, a tablet PC, an MP3 player, a car navigation system, a video phone, etc.

The processor 510 may perform various computing functions. The processor 510 may be a microprocessor, a central processing unit (CPU), an application processor (AP), etc. The processor 510 may be coupled to other components via an address bus, a control bus, a data bus, etc. Further, the processor 510 may be coupled to an extended bus such as a peripheral component interconnection (PCI) bus. The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 530 may include a solid state drive (SSD) device, a hard disk drive (HDD) device, a CD-ROM device, etc. The I/O device 540 may include an input device such as a keyboard, a keypad, a mouse device, a touchpad, a touch-screen, etc., and an output device such as a printer, a speaker, etc. In some example embodiments, the display device 560 may be included in the I/O device 540. The power supply 550 may provide power for operations of the electronic device 500.

The display device 560 may be coupled to other components via the buses or other communication links. In some example embodiments, the display device 560 may be an organic light emitting display device or a liquid crystal display device. However, the display device 560 is not limited thereto. As described above, the display device 560 may provide a high-quality image to a viewer by performing image data compensation that performs color gamut conversion. For this operation, the display device 560 may include a display panel that includes a plurality of pixels, a display panel driving circuit that drives the display panel, and a color gamut converting circuit that extracts an ICC profile included in image data, generates, using the ICC profile, a look-up table for a mapping between a reference color gamut of the display panel and a target color gamut of an image that the image data implements, and compensates the image data based on the look-up table. Thus, the display device 560 may perform, using the ICC profile, the color gamut conversion on the image data based on the mapping between the reference color gamut of the display panel and the target color gamut of the image. As a result, the display device 560 may perform the color gamut conversion on the image data in real time using the ICC profile as the target color gamut of the image is changed. Because performing the color gamut conversion on the image data is described above, duplicated description will not be repeated.

The present inventive concept may be applied to an electronic device including a display device. For example, the present inventive concept may be applied to a head mounted display device, a television, a computer monitor, a laptop, a digital camera, a cellular phone, a smart phone, a smart pad, a smart watch, a tablet PC, an MP3 player, a car navigation system, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A method of performing color gamut conversion, the method comprising:

obtaining an international color consortium (ICC) profile from image data;

extracting XYZ values of red, green, blue, cyan, magenta, yellow, and white of a target color gamut of an image that the image data implements and X'Y'Z' values of red, green, blue, cyan, magenta, yellow, and white of a reference color gamut of a display device from the ICC profile;

calculating a reference color gamut applying matrix that converts the XYZ values to the X'Y'Z' values by substituting the XYZ values of red, green, blue, cyan, magenta, yellow, and white of the target color gamut and the X'Y'Z' values of red, green, blue, cyan, magenta, yellow, and white of the reference color gamut extracted from the ICC profile into the reference color gamut applying matrix;

calculating RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix;

generating a look-up table that comprises the RGB values and the R'G'B' values mapped to the RGB values; and compensating the image data based on the look-up table.

2. The method of claim 1, further comprising:

extracting a gamma value of the display device from the ICC profile;

determining a luminance level correction value based on the gamma value; and reflecting the luminance level correction value on the look-up table.

3. The method of claim 1, wherein the XYZ values correspond to maximum chroma red, maximum chroma green, maximum chroma blue, maximum chroma cyan, maximum chroma magenta, maximum chroma yellow, and maximum chroma white of the target color gamut, and wherein the X'Y'Z' values correspond to maximum chroma red, maximum chroma green, maximum chroma blue, maximum chroma cyan, maximum chroma magenta, maximum chroma yellow, and maximum chroma white of the reference color gamut.

4. The method of claim 3, wherein the RGB values correspond to maximum chroma red, maximum chroma green, maximum chroma blue, maximum chroma cyan, maximum chroma magenta, maximum chroma yellow, and maximum chroma white of the target color gamut, and wherein the R'G'B' values correspond to maximum chroma red, maximum chroma green, maximum chroma blue, maximum chroma cyan, maximum chroma magenta, maximum chroma yellow, and maximum chroma white of the reference color gamut, where the R'G'B' values are mapped to the RGB values.

5. The method of claim 4, wherein the look-up table further comprises additional mappings generated by performing an interpolation on mappings between the RGB values and the R'G'B' values.

6. The method of claim 5, wherein the target color gamut is a sRGB color gamut, an adobe RGB color gamut, or a DCI-P3 color gamut.

7. A method of performing color gamut conversion, the method comprising:

preparing a first look-up table that comprises R1G1B1 values of red, green, blue, cyan, magenta, yellow, and white of a first target color gamut and R1'G1'B1' values of red, green, blue, cyan, magenta, yellow, and white of a reference color gamut, where the R1'G1'B1' values are mapped to the R1G1B1 values;

preparing a second look-up table that comprises R2G2B2 values of red, green, blue, cyan, magenta, yellow, and white of a second target color gamut and R2'G2'B2' values of red, green, blue, cyan, magenta, yellow, and white of the reference color gamut, where the R2'G2'B2' values are mapped to the R2G2B2 values;

obtaining an international color consortium (ICC) profile from image data;

extracting third coordinates of red, green, blue, cyan, magenta, yellow, and white of a third target color gamut of an image that the image data implements from the ICC profile;

calculating first distances between first coordinates of red, green, blue, cyan, magenta, yellow, and white of the first target color gamut and the third coordinates extracted from the ICC profile and second distances between second coordinates of red, green, blue, cyan, magenta, yellow, and white of the second target color gamut and the third coordinates extracted from the ICC profile;

generating a third look-up table that comprises R3G3B3 values of red, green, blue, cyan, magenta, yellow, and white of the third target color gamut and R3'G3'B3' values of red, green, blue, cyan, magenta, yellow, and white of the reference color gamut, where the R3'G3'B3' values are mapped to the R3G3B3 values, by performing an interpolation between the first look-up table and the second look-up table based on the first distances and the second distances; and compensating the image data based on the third look-up table.

8. The method of claim 7, wherein the interpolation is a linear interpolation.

9. The method of claim 8, wherein the first distances are calculated using Equation 1 below:

$$D1=\sqrt{(x3-x1)^2+(y3-y1)^2} \quad \text{Equation 1}$$

where D1 denotes the first distances between the first coordinates and the third coordinates, (x3, y3) denotes the third coordinates, and (x1, y1) denotes the first coordinates.

10. The method of claim 9, wherein the second distances are calculated using Equation 2 below:

$$D2=\sqrt{(x3-x2)^2+(y3-y2)^2} \quad \text{Equation 2}$$

where D2 denotes the second distances between the second coordinates and the third coordinates, (x3, y3) denotes the third coordinates, and (x2, y2) denotes the second coordinates.

11. The method of claim 10, wherein the R3G3B3 values and the R3'G3'B3' values are calculated using Equation 3 below:

Equation 3

$$R_3 = \frac{(R_1 \times D2) + (R_2 \times D1)}{(D1 + D2)} \quad \text{Equation 3}$$

-continued $$R'_3 = \frac{(R'_1 \times D2) + (R'_2 \times D1)}{(D1 + D2)}$$

$$G_3 = \frac{(G_1 \times D2) + (G_2 \times D1)}{(D1 + D2)}$$

$$G'_3 = \frac{(G'_1 \times D2) + (G'_2 \times D1)}{(D1 + D2)}$$

$$B_3 = \frac{(B_1 \times D2) + (B_2 \times D1)}{(D1 + D2)}$$

$$B'_3 = \frac{(B'_1 \times D2) + (B'_2 \times D1)}{(D1 + D2)},$$

where R1 denotes the R1 values, G1 denotes the G1 values, B1 denotes the B1 values, R2 denotes the R2 values, G2 denotes the G2 values, B2 denotes the B2 values, R3 denotes the R3 values, G3 denotes the G3 values, B3 denotes the B3 values, R1' denotes the R1' values, G1' denotes the G1' values, B1' denotes the B1' values, R2' denotes the R2' values, G2' denotes the G2' values, B2' denotes the B2' values, R3' denotes the R3' values, G3' denotes the G3' values, B3' denotes the B3' values, D1 denotes the first distances between the first coordinates and the third coordinates, and D2 denotes the second distances between the second coordinates and the third coordinates.

12. The method of claim 7, further comprising:

extracting a gamma value of a display device from the ICC profile;

determining a luminance level correction value based on the gamma value; and reflecting the luminance level correction value on the third look-up table.

13. The method of claim 7, wherein the R1G1B1 values correspond to maximum chroma red, maximum chroma green, maximum chroma blue, maximum chroma cyan, maximum chroma magenta, maximum chroma yellow, and maximum chroma white of the first target color gamut, and wherein the R1'G1'B1' values correspond to maximum chroma red, maximum chroma green, maximum chroma blue, maximum chroma cyan, maximum chroma magenta, maximum chroma yellow, and maximum chroma white of the reference color gamut, where the R1'G1'B1' values are mapped to the R1G1B1 values.

14. The method of claim 13, wherein the R2G2B2 values correspond to maximum chroma red, maximum chroma green, maximum chroma blue, maximum chroma cyan, maximum chroma magenta, maximum chroma yellow, and maximum chroma white of the second target color gamut, and wherein the R2'G2'B2' values correspond to maximum chroma red, maximum chroma green, maximum chroma blue, maximum chroma cyan, maximum chroma magenta, maximum chroma yellow, and maximum chroma white of the reference color gamut, where the R2'G2'B2' values are mapped to the R2G2B2 values.

15. The method of claim 14, wherein the R3G3B3 values correspond to maximum chroma red, maximum chroma green, maximum chroma blue, maximum chroma cyan, maximum chroma magenta, maximum chroma yellow, and maximum chroma white of the third target color gamut, and wherein the R3'G3'B3' values correspond to maximum chroma red, maximum chroma green, maximum chroma blue, maximum chroma cyan, maximum chroma magenta, maximum chroma yellow, and maximum chroma white of the reference color gamut, where the R3'G3'B3' values are mapped to the R3G3B3 values.

16. The method of claim 15, wherein the third look-up table further comprises additional mappings generated by performing an interpolation on mappings between the R3G3B3 values and the R3'G3'B3' values.

17. A display device, comprising:

a display panel comprising a plurality of pixels;

a display panel driving circuit configured to drive the display panel; and a color gamut converting circuit configured to extract an international color consortium (ICC) profile from image data, to generate, using the ICC profile, a look-up table for a mapping between a reference color gamut of the display panel and a target color gamut of an image that the image data implements, and to compensate the image data based on the look-up table, wherein the look-up table is generated according to, at least in part, a reference color gamut applying matrix that converts XYZ values to X'Y'Z' values by substituting the XYZ values of red, green, blue, cyan, magenta, yellow, and white of the target color gamut and the X'Y'Z' values of red, green, blue, cyan, magenta, yellow, and white of the reference color gamut that are extracted from the ICC profile into the reference color gamut applying matrix.

18. The device of claim 17, wherein the color gamut converting circuit is implemented in the display panel driving circuit.

19. The device of claim 17, wherein the color gamut converting circuit is configured to extract the XYZ values of red, green, blue, cyan, magenta, yellow, and white of the target color gamut and the X'Y'Z' values of red, green, blue, cyan, magenta, yellow, and white of the reference color gamut from the ICC profile, to calculate the reference color gamut applying matrix that converts the XYZ values to the X'Y'Z' values, to calculate RGB values of red, green, blue, cyan, magenta, yellow, and white of the target color gamut and R'G'B' values of red, green, blue, cyan, magenta, yellow, and white of the reference color gamut using the reference color gamut applying matrix and an RGB-XYZ converting matrix, and to generate the look-up table that comprises the RGB values and the R'G'B' values mapped to the RGB values.

20. The device of claim 19, wherein the color gamut converting circuit is configured to extract a gamma value of the display panel from the ICC profile, to determine a luminance level correction value based on the gamma value, and to reflect the luminance level correction value on the look-up table.

* * * * *